United States Patent [19]

Banton

[11] Patent Number: 4,551,008

[45] Date of Patent: Nov. 5, 1985

[54] IMAGE ANNOTATOR FOR USE WITH PRINTING AND COPYING MACHINES

[75] Inventor: Martin E. Banton, Fairport, N.Y.

[73] Assignee: Xerox Corporation, Stamford, Conn.

[21] Appl. No.: 564,256

[22] Filed: Dec. 22, 1983

[51] Int. Cl.[4] ..... G03G 15/04

[52] U.S. Cl. ..... 355/14 E; 355/3 R; 355/39; 355/40

[58] Field of Search ..... 355/3 R, 39, 40, 14 E, 355/14 R; 346/155

[56] References Cited

U.S. PATENT DOCUMENTS

| | | | |
|---|---|---|---|
| 3,698,297 | 10/1972 | Herden | 95/4.5 R |
| 3,800,303 | 3/1974 | Picquendar et al. | 355/3 R X |
| 4,229,081 | 10/1980 | Jones et al. | 350/361 |
| 4,317,611 | 3/1982 | Petersen | 350/6.6 |
| 4,343,536 | 8/1982 | Watanabe et al. | 350/355 |
| 4,367,925 | 1/1983 | Sprague et al. | 350/355 |
| 4,447,148 | 5/1984 | Hatzis | 355/3 R X |
| 4,450,458 | 5/1984 | Araghi et al. | 346/155 |
| 4,490,032 | 12/1984 | Conly et al. | 355/3 R X |

OTHER PUBLICATIONS

Applied Physics Letters, vol. 31, No. 8, Oct. 15, 1977, K. E. Petersen, p. 521.

IEEE Transactions on Electron Devices, vol. ED-25, No. 10, Oct. 1978, K. E. Petersen, p. 1241.

*Primary Examiner*—Fred L. Braun

*Attorney, Agent, or Firm*—Frederick R. McMullen

[57] ABSTRACT

An array of flexible reflective fingers, light from a source impinging on the fingers which reflect the light in a first path, the fingers bending when a predetermined potential is applied to reflect the light in a second path, one of the paths impinging on a recording member, a source of annotated image signals, and a control for applying the potential selectively to individual fingers of the array in response to the annotated image signals to expose the recording member and create an annotated image on the recording member.

9 Claims, 8 Drawing Figures

65
67
6
72'
71
72
69
66
70
75
76
69'
68
77
69'
81
78
80
83
69'
16
W
10
101

IMAGE ANNOTATOR FOR USE WITH PRINTING AND COPYING MACHINES

The invention relates to an annotator for adding additional information to copies, and more particularly, to an improved annotator having an array of flexible light reflecting fingers individually actuable to create the annotated image.

As known to those skilled in the copier arts, it is oftimes desired to add certain information such as instructions, caveats, names, addresses, and the like, to copies being produced by a copier or reproduction machine. This information, which does not appear in the original image, is usually of only a few words and one or two lines duration. To avoid interference with the original image and to assure legibility of both the original image being copied and the annotated image being added, the annotated image is placed in some non-image area, typically, the copy margin.

While annotators through the years have taken many different forms ranging from a simple overlay to relatively expensive and complex exposure systems, most prior art arrangements have not proven practical. This is usually traceable to the annotator cost, the increased amount of time and effort imposed on the operator to set up and place the annotated image in desired position, the difficulty in synchronizing exposure of the annotated image with that of the original image being reproduced by the copier or reproduction machine, etc.

The invention is intended to provide an annotator of relatively low expense which is simple and easy to set up and operate, such annotator being for use with a copying or printing machine of the type having a recording member such as a photoreceptor; charging means for uniformly charging the recording member in preparation for imaging; means for exposing the recording member to produce a latent electrostatic copy image on the recording member; developing means for developing images on the recording member; and transfer means for transferring developed images to a copy sheet, the improvement comprising: an array of flexible reflective fingers, the fingers being selectively movable between a deflected and an undeflected position; a light source, the light source being arranged to impinge light across the array of fingers, the fingers reflecting the light in one of the deflected and undeflected position onto the recording member; means to apply a deflection potential to discrete ones of the fingers in response to an image signal representing the annotated image to thereby move the discrete ones of the flexible fingers to the deflected position whereby the array produces a light pattern corresponding to the image signal for exposing the recording member and creating an annotated image thereon; and means for synchronizing input of the image signals with the position of the copy image on the recording member whereby to create the annotated image within the borders of the copy image.

IN THE DRAWINGS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
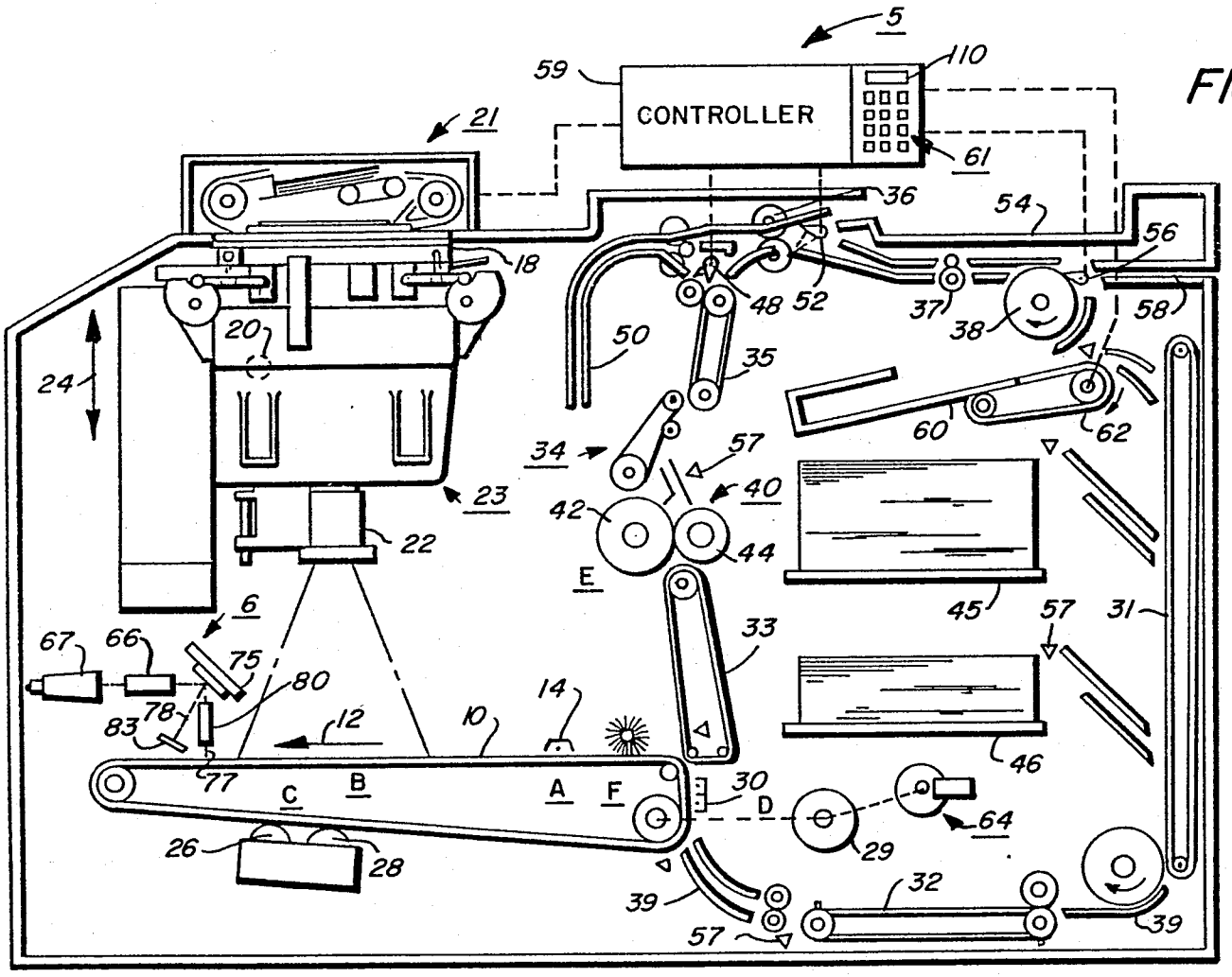
FIG. 1 is a plan view of a reproduction machine of the type adapted to incorporate the annotator of the present invention.

For a general understanding of the features of the present invention, reference is had to the drawings. In the drawings, like reference numerals have been used throughout to designate identical elements. FIG. 1 schematically depicts the various components of an illustrative electrophotographic copying or printing machine 5 incorporating the annotator, designated generally by the numeral 6, of the present invention. It will become evident from the following discussion tha the invention is equally well suited for use in a wide variety of printing and copying machines and is not necessarily limited in its application to the particular embodiment shown herein.

Inasmuch as the art of electrophotographic copying and printing is well known, the various processing stations employed in the printing machine 5 will be shown hereinafter schematically and their operation described briefly with reference thereto.

As shown in FIG. 1 the illustrative electrophotographic copying or printing machine 5 employs a recording member in the form of a belt 10 having composite photoconductive layers thereon. Belt 10 is driven by main drive motor 29 and moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 21, positions original documents 16 facedown on a platen 18 over exposure system 23. The exposure system, indicated generally by reference numeral 23, includes lamp 20 which illuminates the document 16 positioned on transparent platen 18. The light rays reflected from document 16 are transmitted through lens 22. Lens 22 focuses the light image of original document 16 onto the previously charged photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C.

Platen 18 is mounted movably and arranged to move in the direction of arrows 24 to adjust the magnification of the original document being reproduced. Lens 22 moves in synchronism therewith so as to focus the light image of original document 16 onto the photoconductive surface of belt 10.

Document handling unit 21 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured. Preferably, magnification of the imaging system is adjusted to insure that the indicia or information contained on the original document is reproduced within the space of the copy sheet.

While a document handling unit has been described, one skilled in the art will appreciate that the original document may be manually placed on the platen rather than by the document handling unit. This is required for a machine which does not include a document handling unit.

A plurality of sheet transports comprising a vertical transport 31, a registration transport 32, prefuser transport 33, decurler 34, post fuser transport 35, output transport 36, bypass transport 37, and inverter roll 38, cooperate with suitable sheet guides 39 to form a paper path through which the copy sheets 11 being processed pass from either main paper supply tray 45, or auxiliary paper supply tray 46, or duplex paper supply tray 60 through the machine 5 to either top tray 54 or discharge path 58. Transports 31, 32, 33, 34, 35, 36, 37, 38 are suitably driven by main drive motor 29. Suitable sheet sensors designated here by the numeral 57, are provided at strategic locations along the paper path, i.e. at the output of paper trays 45, 46, the inlet to prefuser transpoart 33, etc. to detect the passage of copy sheets.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into transfer relation with the toner powder image. Transfer station D includes a corona generating device 30 which sprays ions onto the backside of the copy sheet. This attracts the toner powder image from the photoconductive surface of belt 10 to the sheet. After transfer, prefuser transport 33 advances the sheet to fusing station E.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, decurler 34 and post fuser transport 35 carry the sheets to inverter gate 48 which functions as an inverter selector. When energized or pulled, gate 48 directs the copy sheets into a sheet inverter 50. When inoperative, gate 48 bypasses sheet inverter 50 and the sheets are fed directly to bypas gate 52. Thus, copy sheets which bypass inverter 50 turn a 90° corner in the paper path before reaching gate 52. Bypass gate 52 directs the sheets into top tray 54 so that the imaged side which has been transferred and fused is faceup. If inverter 50 is selected, the opposite is true, i.e. the last printed face is facedown. Bypass gate 52 normally directs the sheet into top tray 54 or, when energized, to bypass transport 37 which carries the sheet to duplex gate 56. Gate 56 either directs the sheets without inversion to the discharge path 58 or, when energized, to duplex inverter roll 38. Inverter roll 38 inverts and directs the sheets to be duplexed into duplex tray 60. Duplex tray 60 provides intermediate or buffer storage for those sheets which have been printed on one side and on which an image will be subsequently printed on the side opposed thereto, i.e. the copy sheets being duplexed. Due to the sheet inverting action of inverter roll 38, the buffer set of sheets are stacked in duplex tray 60 facedown in the order in which the sheets have been copied.

In order to complete duplex copying, the previously simplexed sheets in tray 60 are fed seriatim by bottom feeder 62 back via vertical transport 31 and registration transport 32 to transfer station D for transfer of the toner powder image to the opposed side of the sheet. Inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to the selected output for subsequent removal by the machine operator.

A controller 59 for controlling machine 5 is provided at some convenient location on or adjacent to machine 5. Controller 59 includes a suitable control panel 61 to enable the user or operator to program the copy run desired and monitor operation of machine 5. A control system resident in machine 5, which may include one or more microprocessors and various memories, controls operation of the various machine components in accordance with the copy run programmed through control panel 61. The aforementioned control system includes timing means for synchronizing operation of the machine components with one another, machine 5 having one or more clocks such as machine clock 64 driven from main motor 29 for generating timing clock pulses.

Figure 2:
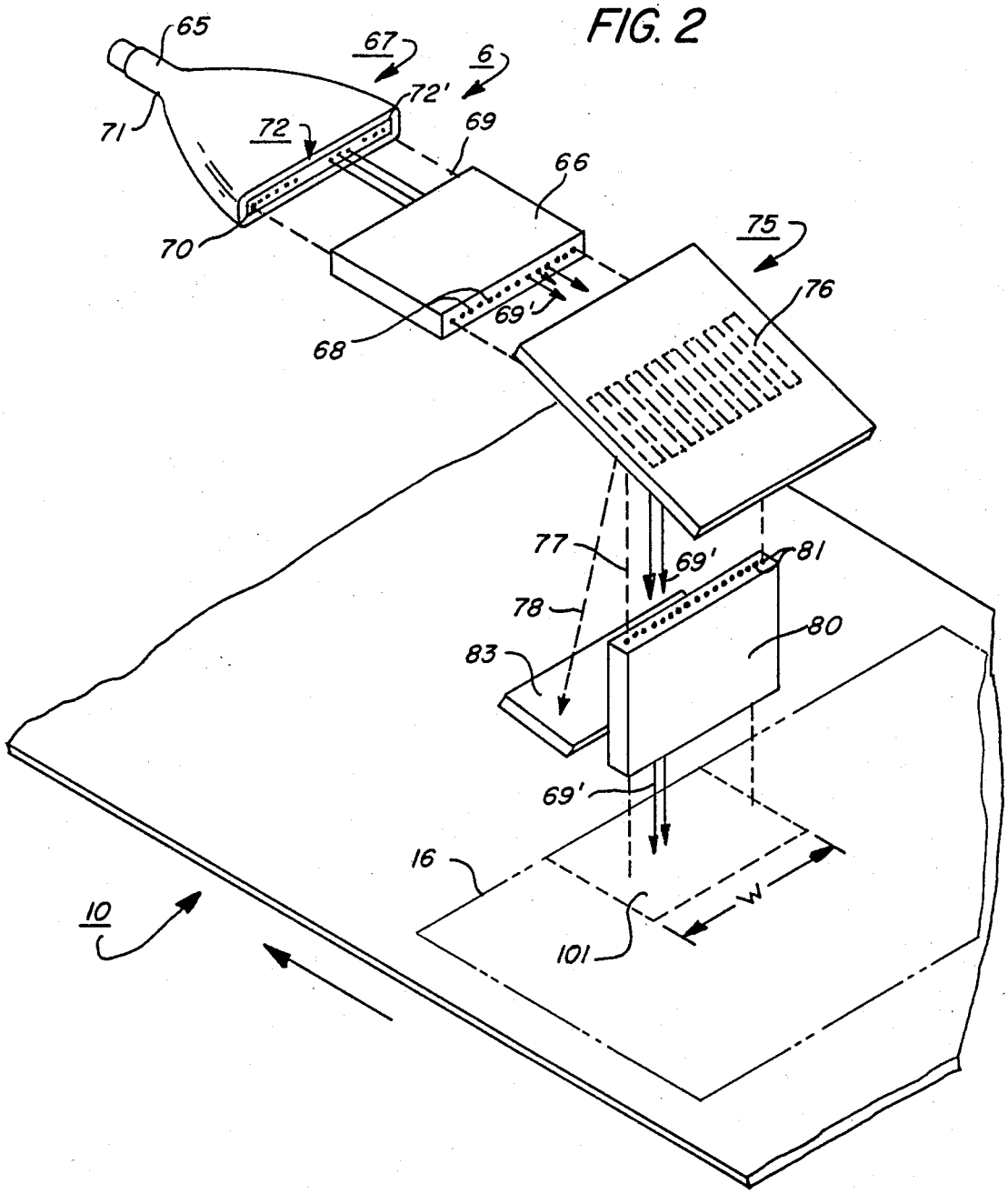
FIG. 2 is an enlarged isometric view of the annotator shown in FIG. 1.

Referring particularly to FIGS. 1 and 2 of the drawings, annotator 6 serves to selectively expose normally a background area within the confines of the latent electrostatic image on belt 10 to image information or data in the form of image signals or pixels to provide a second annotated image on belt 10 in selected positional relationship to the document image.

The image provided by annotator 6 may for example be names and/or addresses, prohibitions against copying or reproducing the document, etc. As will appear, the image provided by annotator 6 may be located at any convenient or desired point on the copy produced by machine 5.

A high intensity light such as a tungsten halogen lamp 65 serves as a source of illumination for annotator 6. A round to rectangular fiber optic bundle 67 serves to change the generally circular light beam of lamp 65 to a line-like beam or array 69 of individual light rays 69' for exposing the photoconductor surface of belt 10 reserved for the annotated image a line at a time as will appear. Fiber optic bundle 67 comprises a plurality of fiber optic elements 70 assembled together to form a unitary structure with the light receiving ends of fiber optic elements 70 being embedded in one end of a hollow epoxy rod 71 to provide a generally round light input side. The light discharge end of lamp 65 is disposed in the opposite end of the rod 21, the respective depths to which the fiber optic elements 70 and lamp 65 are inserted being dependent upon the illumination characteristics desired. Lamp 65 and fiber optic bundle 67 are supported in predetermined positional relation to one another such that fiber bundle 67 emits a light beam 69 composed of a plurality of individual light rays 69'. A beam control aperture plate 72 having a light transmitting aperture 72' therethrough of predetermined dimension is disposed at the discharge side of fiber optic bundle 67.

A gradient index array 66 of fiber lenses, the individual lenses 68 of which serve to guide and focus the individual light rays 69' emitted by fiber optic bundle 67 onto the ends (89) of the individual reflector fingers 76 of modulator 75 is disposed between aperture plate 72 and modulator 75. As will appear, reflector fingers 76 of modulator 75 selectively reflect the light rays 69' impinging thereupon at one of two angles to provide either a zero order beam 77 or a first order beam 78 accordance with the content of the image signal input to modulator 75. The light rays 69' that comprise zero order beam 77 at any instant in time are reflected to a gradient index array 80 of fiber lenses, the individual lenses 81 of which serve to guide and focus the individual light rays of zero order beam 77 onto belt 10 at a point downstream of imaging station B. Lens array 80 is supported in predetermined positional relationship to modulator 75 and the individual reflector fingers 76, and to the photoconductive surface belt 10.

The aforesaid fiber lenses 66, 80 are produced under the trade name "SELFOC", a mark registered in Japan and owned by Nippon Sheet Glass Co., Ltd. As will be understood, the number of individual reflector fingers 76 that comprise modulator 75 is determinative of the image resolution, the number of fiber elements in fiber optic bundle 67 and lens arrays 66, 80 in turn being equal to the number of reflector fingers 76 that comprise modulator 75.

A beam stop 83 which is comprised of any suitable light impervious or absorbing material is interposed in the path of first order beam 78.

Figure 3:
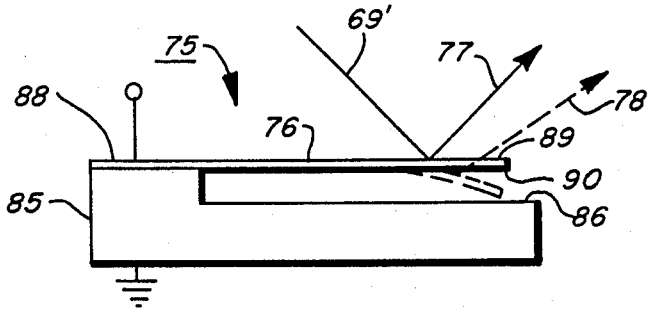
FIG. 3 is a side view in cross section showing details of the annotator modulator and illustrating the manner in which light is modulated.
Figure 4:
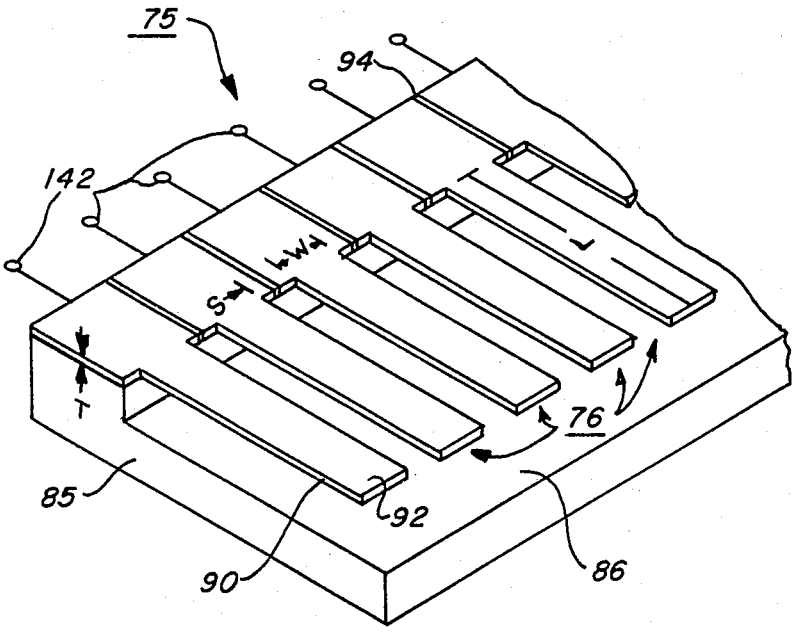
FIG. 4 is an enlarged isometric view of the modulator shown in FIG. 3.

Referring particularly to FIGS. 3 and 4 of the drawings, electromechanical modulator 75 has an elongated generally rectangular base 85 which may for example comprise a silicon chip. The thickness of base 85 is reduced at 86 to permit bending or arcing of reflector fingers 76, which in turn comprise elongated flexible wafers or membranes secured to base 85 in closely spaced side by side relation at the finger end 88. As a result, the opposite end 89 of reflector fingers 76 projects outwardly in cantilever fashion above the reduced thickness section 86 of base 85. Preferably, reflector fingers 76 each comprise a relatively thin flexible silicon dioxide substrate 90, the outer surface of which is covered with a conductive highly reflective coating or layer 92 which may for example comprise chromium. Fingers 76 are insulated from one another as by gaps 94 in the conductive layer 92 between adjoining fingers. A modulator 75 having some 300 reflector fingers 76 with a length (L) of 100 um, a width (W) of 50 um, and a thickness (T) of 0.25 um, and spaced apart by a distance (S) of 5 um, may be envisioned. As will be understood, the operating length of the modulator 75, that is, the overall length of the array of reflector fingers 76 is at least equal to the maximum width of the image to be produced. For example, where a 2 by 2 inch annotated image is to be processed, the overall length of the array of reflector fingers 76 on base 85 would be at least 2 inches.

Reflector fingers 76 respond to the imposition of a voltage across base 85 and the conductive layer 92 thereof, the resulting electrostatic force causing the reflector finger 76 to which the voltage is applied to bend or deflect downwardly (as shown by the dotted lines in FIG. 3). The degree of bending or deflection obtained is dependent upon the voltage applied, and has been found to increase with increases in voltage up to a predetermined maximum. Typically, a maximum deflection of approximately 5° may be realized by the application of approximately 15 volts, the resonant frequency of the cantilevered reflector fingers 76 being approximately 23 kHz. As a result, the direction in which light striking the reflective upper layer 92 of fingers 76 is reflected may be controlled by controlling the voltage applied to the individual reflector fingers 76.

Figure 5:
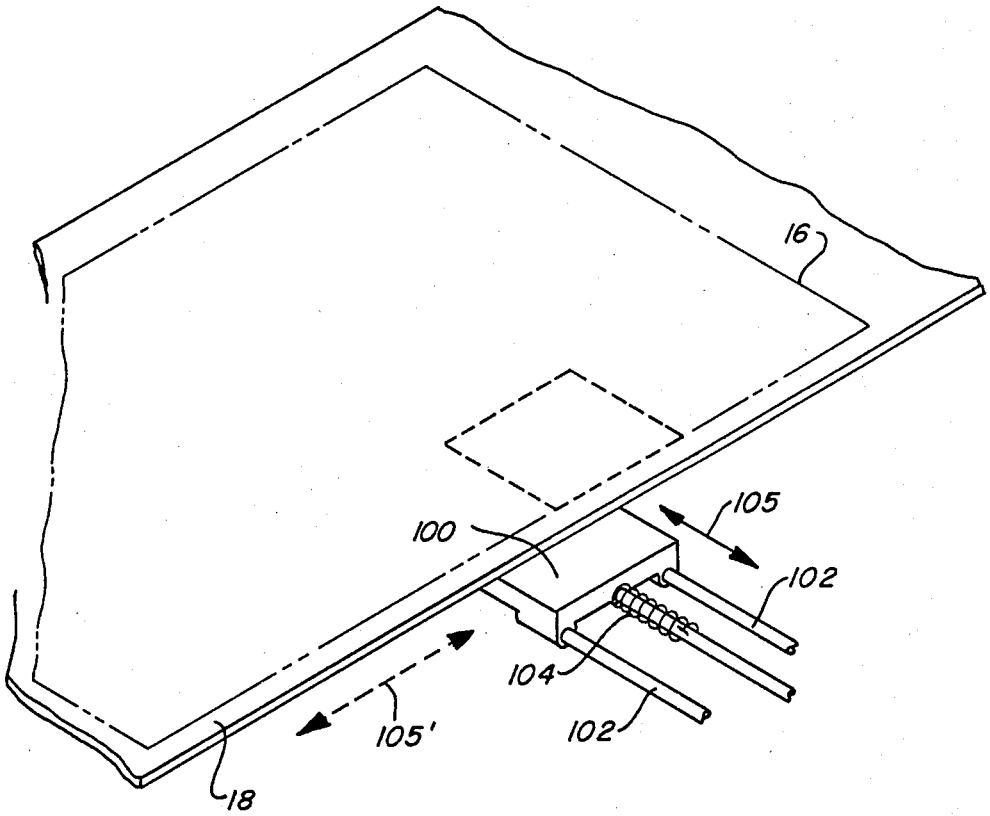
FIG. 5 is an isometric view illustrating the document supporting platen of the reproduction machine shown in FIG. 1 in association with the annotator non-exposure mask.

Referring particularly to FIG. 5, platen 18 comprises a generally rectangular transparent (i.e. glass) member, the dimensions of which are chosen to provide a support for the maximum size document 16 to be reproduced by machine 5. In the embodiment shown, a dark (i.e. black) opaque generally rectangular mask 100 is supported adjacent one side of platen 18 on guide rods 102 for slideable movement into predetermined position below platen 18. A suitable driver such as solenoid 104 is provided to move mask 100 back and forth selectively along rods 102, energization of solenoid 104 advancing mask 100 forward in the direction of arrow 105 to the predetermined position (shown in dotted lines) below platen 18.

As will be understood, mask 100, when disposed below platen 18, absorbs light from exposure lamp 20 to prevent discharge by the machine exposure system 23 of a correspondingly shaped image area 101 on the photoconductive surface of belt 10 as shown in FIG. 2. As will appear, the undischarged image area 101 on belt 10 is utilized by annotator 6 to provide a second image of the annotated information.

Figure 6:
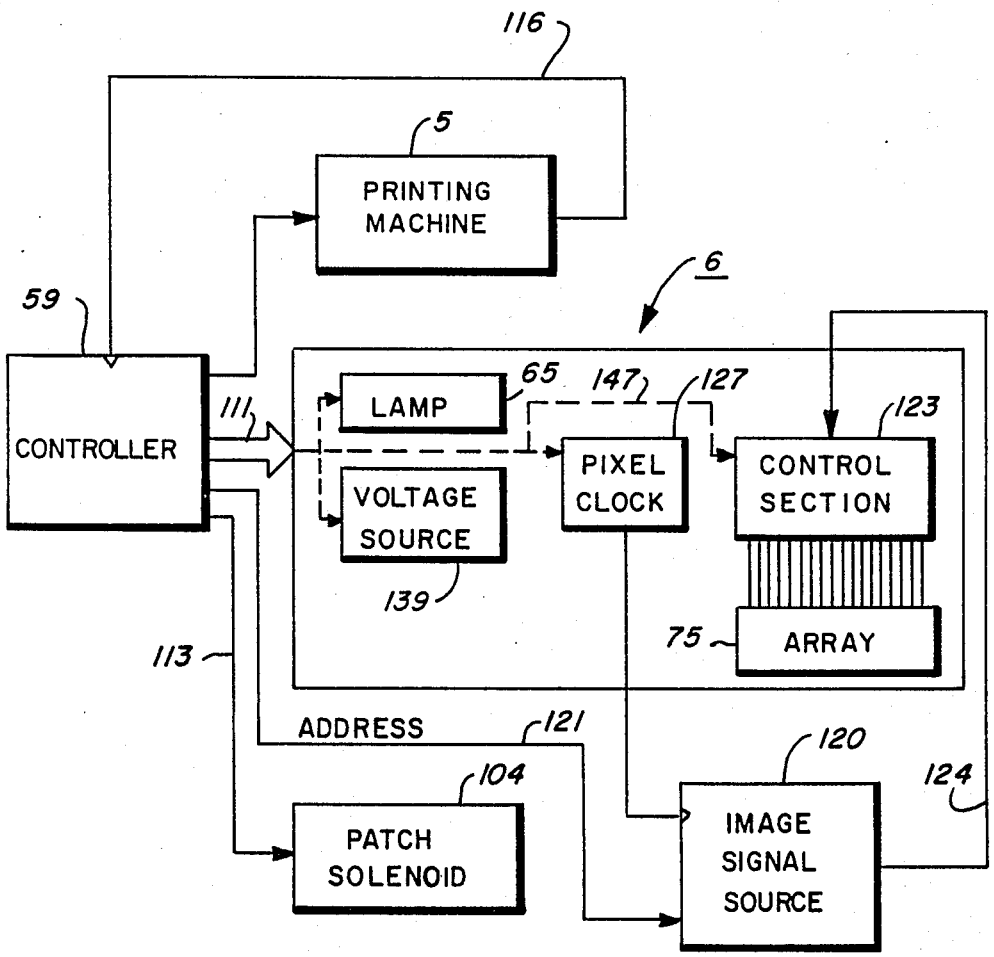
FIG. 6 is a block diagram of the control system for the annotator of the present invention.

Referring to FIG. 6 of the drawings, operation of annotator 6 is controlled through controller 59, the operator control panel 61 of controller 59 having a suitable selector means, represented by button 110 (shown in FIG. 1), for controlling operation of annotator 6 and solenoid 104.

Controller 59 is coupled to annotator 6 through control bus 11 and to patch drive solenoid 104 through control line 113. Timing signals for synchronizing operation of annotator 6 with the processing of images by printing machine 5, and particularly for starting and stopping exposure by annotator 6, are input to controller 59 through machine clock line 116.

Image signals of the annotated image to be reproduced by annotator 6 are derived from a suitable image signal source 120. Image signal source 120 normally comprises a suitable memory wherein image signals representing the annotated image or images available are stored. As will be understood, where various annotated images are provided, suitable addressing means, represented by address line 121, are provided to enable the operator to choose the annotated image desired, such addressing means (not shown) being conveniently provided on control panel 61 for ready used by the operator. Other sources of the annotated images, such as a communication channel, computer, etc may be envisioned.

Figure 7:
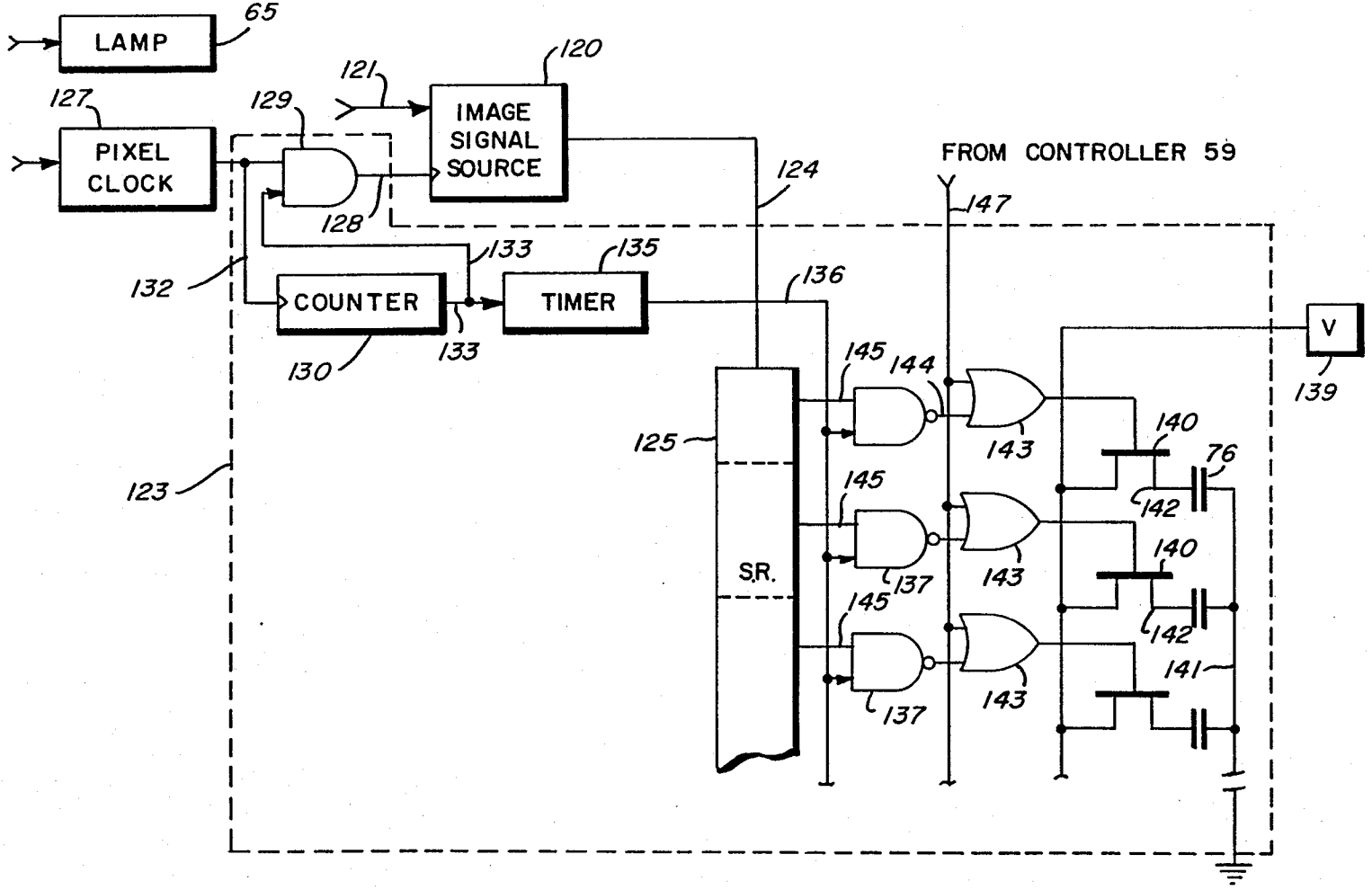
FIG. 7 is a logic diagram showing details of the annotator control section.

Referring now to FIG. 7, control section 123 of annotator 6 has series to parallel shift register 125 coupled by image data line 124 to the output side of image signal source 120. A suitable pixel clock 127 is provided for clocking the image signals from image signal source 120 to shift register 125, pixel clock 127 being coupled to image signal source 120 by clock lead 128 through AND function gate 129. Actuation of pixel clock 127 is in response to the control signal input from controller 59. Annotator lamp 65 is similarly controlled by a control signal from controller 59.

To control loading of image signals from image signal source 120 into shift register 125, a suitable counter 130 is provided, counter 130 being driven by clock pulses output by pixel clock 127 through clock line 132. The output side of counter 130 is coupled by line 133 to a second input of gate 129 and to the input terminal of a suitable exposure interval timer 135. The output side of timer 135 is coupled to one input of exposure control gates 137 by line 136.

A suitable deflecting voltage source 139 is provided for bending reflector fingers 76, voltage source 139 being coupled to the array of reflector fingers 76 through control gates 140 and lines 142. Base 85 of modulator 75 is grounded by line 141. The control terminals of individual gates 140 are coupled through OR function gates 143 to the output sides of exposure control gates 137 through lines 144. The individual output stages of shift register 125, which equal the number of reflector fingers 76 that comprise modulator 75, are coupled by lines 145 to a second input of exposure control gates 137. A control line 147 couples controller 59 to a second input of OR gates 143.

OPERATION

During operation of printer 5, control signals from controller 59 in buss 111 and line 147 actuates annotator 6 to a ready state. In this state, annotator lamp 65, voltage source 139, and control gates 140 are actuated, the latter through OR function gate 143. With control gates 140 actuated, the potential applied across the array of reflector fingers 76 of modulator 75 causes fingers 76 to bend to the dotted line position shown in FIG. 3. As a result, the light rays 69' impinging thereon from lens array 66 are reflected in total by the array of fingers 76 as a first order beam 78 against beam stop 83.

Where it is desired to add an annotated image, controller 59 is programmed by actuating push button 110 on control panel 61. A control signal from controller 59 energizes solenoid 104 to move mask 100 forward (in the direction shown by arrow 105) into position below platen 18. On a predetermined clock count from machine clock 64, which represents movement of the charged but unexposed image area 101 into operative relation with annotator 6, gates 140 are inactivated to interrupt the application of potential from voltage source 139 to the array of reflector fingers 76. With the termination of the electrostatic force on the array of fingers, the fingers spring back to the straight or level position shown by the solid lines of FIG. 3. Light ray 69' impinging against the array of undeflected fingers 76 are reflected along the zero beam path 77 to lens array 80, and through lens array 80 to generate a sheet-like beam of light 69 at least equal in width to the width W of the annotated image area 101 to erase any charges on the photoconductive surface of belt 10 leading up to exposure of the first annotated image line.

On a subsequent clock count from machine clock 64, a signal from controller 59 starts pixel clock 127. The clock signal input to image signal source 120 loads shift register 125 with the first line of annotated image signals. Concurrently, the clock pulses from clock 127 drive counter 130. On the count in counter 130 reaching a preset count equal to the number of image signals that comprise the annotated image line, a signal from counter 130 disables gate 129 to temporarily terminate the input of clock pulses from pixel clock 127 to image signal source 120. The signal from counter 130 also actuates timer 135 to apply an enabling signal to expousre control gates 137 for a preset exposure interval.

Where the potential of the image signals at the output of the individual shift register stages is relatively low (i.e. a binary 0), the state of the control gate 137 associated therewith remains unchanged. As a result, the reflector fingers 76 controlled by the unactuated control gates 137 remain in the undeflected state and the individual light rays 69' striking these reflector fingers continue to be reflected along the path of zero order beam 77 and onto the photoconductive surface of belt 10 to thereby selectively expose a line-like portion of the charged image area 101.

Where the image signals at the output of the individual shift register stages is relatively high, (i.e. a binary 1), the exposure control gate 137 associated therewith is triggered to actuate the associated control gate 140 and couple voltage source 139 across the reflector finger 76 associated therewith. Application of potential across the reflector finger generates an electrostatic force causing the finger to bend or deflect to the position shown by the dotted lines of FIG. 3. Light rays 69' impinging against any of the now deflected fingers 76 are reflected along the first order zero beam bath 78 and impinge against beam stop 83. Accordingly, the annotated image area 101 of the photoconductive surface of belt 10 is not exposed in these areas.

The selective exposure of the image area 101 on belt 10 effects an image-wise discharge thereof to create a latent electrostatic image of the annotated image line in accordance with the first line of image signals output by image signal source 120.

Following a preset exposure interval, timer 135 resets and the next line of image signals is loaded into shift register 125 as belt 10 moves forward one line. The aforedescribed exposure process is repeated for the next line and so forth and so on until the annotated image is completed. On completion of the annotated image, a control signal from controller 59 resets annotator 6 to the ready state. Where no further annotated images are desired, a signal from controller 59 deenergizes solenoid 104 to withdraw patch 100.

It will be understood that mask 100 may be arranged for bidirectional movement, i.e. in the direction shown by the dotted line arrow 105' in FIG. 5 in addition to the direction shown by the solid line arrow 105. Where mask 100 is moved in the direction of the dotted line arrow 105', proportional repositioning of annotator 6 must also be effected if the predetermined positional relationship between annotator 6 and the charged image area 101 on belt 10 is to be maintained.

The size of the image area 101 in one dimension may be changed or adjusted by controlling the extent of movement of mask 100 into the platen area. And the physical size and shape of mask 100 may be varied to vary the image area 101 so long as the size and shape of the image area 101 created is sufficient for the annotated image. It is also understood that the width (W) of image area 101 in the direction of arrow 105' cannot exceed the effective width of annotator 6.

Figure 8:
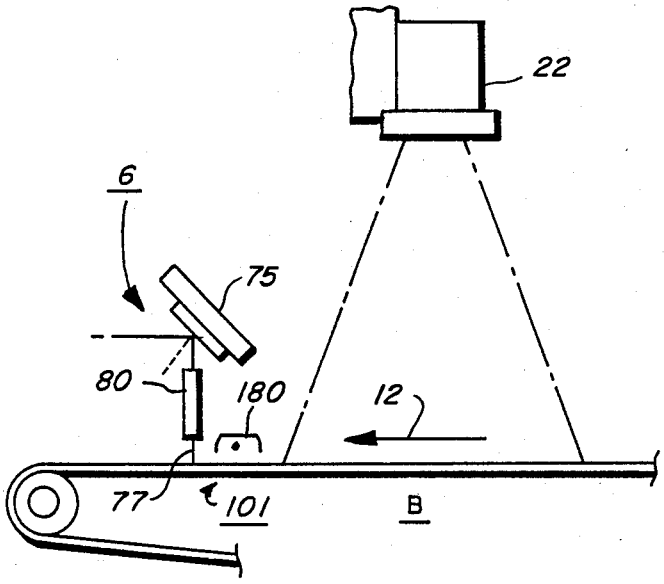
FIG. 8 is a view of a section of the machine shown in FIG. 1 depicting an alternate embodiment in which a second corona generating device is provided downstream of the image exposure station to charge an area of the photoreceptor for exposure by the annotator of the present invention.

Instead of creating image area 101 by excluding light through the interposition of an object such as mask 100 between the illumination source and the document 16 on platen 18, a second relatively small corona generating device 180 having an effective charging width substantially equal to the effective operating width of annotator 6, may instead by provided at some convenient point between exposure station B and annotator 6 to create the charged image area 101 as shown in FIG. 8. This arrangement permits the image area 101 and the annotated image to be located at any position on the copy since no potentially intruding supporting structure is required such as that used to support mask 100 in the embodiment described. Further, by using a second corona charging device, the use of automatic type document handlers with copying or printing machines of the type shown is facilitated since that arrangement permits rapid and controlled creation of the image area 101. This is useful for example where it is desired to place the annotated image on only a predetermined one or ones of the copy series such as on the outer cover or first page of a book.

As is believed apparent from the foregoing, there is provided an annotator capable of providing annotated images of various types in a selected area of copies as the copies are produced. The subject annotator is small in size, readily and inexpensively fabricated by conventional IC technology, uses a relatively inexpensive incandescent illumination assembly as opposed to a laser, and requires only minimal operator involvement.

While the invention has been described with reference to the structure disclosed, it is not confined to the details set forth, but is intended to cover such modifications or changes as may come within the scope of the following claims.

I claim:

1. An annotator for use with a copying or printing machine of the type having a recording member such as a photoreceptor; charging means for uniformly charging the recording member in preparation for imaging; means for exposing the recording member to produce a latent electrostatic copy image on the recording member; developing means for developing images on the recording member; and transfer means for transferring developed images to a copy sheet, comprising:

(a) an array of flexible reflective fingers, said fingers being selectively movable between a deflected and an undeflected position;

(b) a light source, said light source being arranged to impinge light across said array of fingers, said fingers reflecting said light in one of said deflected and undeflected positions onto said recording member;

(c) means to apply a deflection potential to discrete ones of said fingers in response to an image signal representing the annotated image to thereby move said discrete ones of said flexible fingers to said deflected position whereby said array produces a light pattern corresponding to said image signal for exposing said recording member and creating an annotated image thereon; and (d) means for synchronizing input of the image signals with the position of said copy image on said recording member whereby to create said annotated image within the borders of said copy image.

2. The annotator according to claim 1 including memory means for storing plural annotated images, and address means responsive to a selected annotated image to address said memory means whereby said memory means provides image signals representing said selected annotated image to said annotator.

3. In a copying or printing machine of the type having a recording member such as a photoreceptor; charging means for uniformly charging the recording member in preparation for imaging; means for exposing the recording member to produce a latent electrostatic copy image on the recording member; developing means for developing images on the recording member; and transfer means for transferring developed images to a copy sheet, the improvement comprising:

(a) an array of flexible reflective fingers, said fingers being selectively movable between a deflected and an undeflected position;

(b) a light source, said light source being arranged to impinge light across said array of fingers, said fingers reflecting said light in one of said deflected and undeflected positions onto said recording member;

(c) means to apply a deflection potential to discrete ones of said fingers in response to an image signal representing the annotated image to thereby move said discrete ones of said flexible fingers to said deflected position whereby said array produces a light pattern corresponding to said image signal for exposing said recording member and creating an annotated image thereon;

(d) means to provide a predetermined charged area on said recording member for said annotated image within the borders of said copy image; and (e) means for synchronizing input of the image signals with the position of said copy image on said recording member whereby to create said annotated image on said predetermined charged area.

4. In a copying or printing machine of the type having a recording member such as a photoreceptor; charging means for uniformly charging the recording member in preparation for imaging; means for exposing the recording member to produce a latent electrostatic copy image on the recording member; developing means for developing images on the recording member;

and transfer means for transferring developed images to a copy sheet, the improvement comprising:

(a) an array of flexible reflective fingers, said fingers being selectively movable between a deflected and an undeflected position;

(b) a light source, said light source being arranged to impinge light across said array of fingers, said fingers reflecting said light in one of said deflected and undeflected positions onto said recording member;

(c) means to apply a deflection potential to discrete ones of said fingers in response to an image signal representing the annotated image to thereby move said discrete ones of said flexible fingers to said deflected position whereby said array produces a light pattern corresponding to said image signal for exposing said recording member and creating an annotated image thereon;

exposure preventing means to prevent exposure of a predetermined area of said recording member by said exposing means whereby to provide a predetermined charged area on said recording member for said annotated image within the borders of said copy image; and (e) means for synchronizing input of the image signals with the position of said copy image on said recording member whereby to create said annotated image on said predetermined charged area.

5. The machine according to claim 4 in which said machine includes a platen for supporting an original to be copied, said exposing means exposing the original on said platen to provide a latent electrostatic image of said original on said recording member;

said exposure preventing means comprising a mask interposable between said exposing means and said platen to inhibit exposure of a corresponding area of said recording member by said exposing means an create said predetermined charged area for said annotated image.

6. The machine according to claim 5 including drive means adapted when actuated to interpose said mask between said exposing means and said platen; and control means for actuating said drive means when said annotated image is to be provided.

7. In a copying or printing machine of the type having a recording member such as a photoreceptor; first charging means for uniformly charging the recording member in preparation for imaging; means for exposing the recording member to produce a latent electrostatic copy image on the recording member; developing means for developing images on the recording member; and transfer means for transferring developed images to a copy sheet, the improvement comprising:

(a) an array of flexible reflective fingers, said fingers being selectively movable between a deflected and an undeflected position;

(b) a light source, said light source being arranged to impinge light across said array of fingers, said fingers reflecting said light in one of said deflected and undeflected positions onto said recording member;

(c) means to apply a deflection potential to discrete ones of said fingers in response to an image signal representing the annotated image to thereby move said discrete ones of said flexible fingers to said deflected position whereby said array produces a light pattern corresponding to said image signal for exposing said recording member and creating an annotated image thereon;

second charging means upstream of said annotator for charging said recording member following exposure of said recording member by said exposing means to provide a predetermined charged area on said recording member for said annotated image within the borders of said copy image; and (e) means for synchronizing input of the image signals with the position of said copy image on said recording member whereby to create said annotated image on said predetermined charged area.

8. In a reproduction machine having a photoreceptor and means to create through exposure a first image on said photoreceptor, the combination of:

(a) exposure inhibiting means to prevent exposure of a preset area of said photoreceptor within the boundary of said first image for a second image; and (b) annotator means for creating said second image in said photoreceptor preset area including (1) a plurality of deflectable light reflecting finger-like elements, said finger-like elements being arranged in at least one linear array;

(2) means for impinging light across said array of finger-like elements, said finger-like elements reflecting said light impinging thereon along a first light path;

(3) means to apply a deflection potential to said finger-like elements individually in response to image signals representing said second image so that certain ones of said finger-like elements in said array are deflected, deflected ones of said finger-like elements reflecting light impinging thereon along a second light path;

(4) means for optically coupling one of said first and second light paths to said photoreceptor whereby light patterns created by sid array of finger-like elements corresponding to said image signals are transmitted to said photoreceptor to expose said photoreceptor preset area and create said second image thereon; and (5) control means for actuating said annotator means in synchronism with creation of said first image on said photoreceptor.

9. The machine according to claim 8 in which said exposure inhibiting means includes a light blocking element selectively insertable into the exposure path of said first image to prevent discharge of said photoreceptor preset area.

* * * * *